US011877636B2

(12) United States Patent
Vo et al.

(10) Patent No.: US 11,877,636 B2
(45) Date of Patent: Jan. 23, 2024

(54) HANDBAG WITH SHOE COMPARTMENT

(71) Applicants: Uzra Vo, Tempe, AZ (US); Tamula Shreve, Tempe, AZ (US)

(72) Inventors: Uzra Vo, Tempe, AZ (US); Tamula Shreve, Tempe, AZ (US)

( * ) Notice: Subject to any disclaimer, the term of this patent is extended or adjusted under 35 U.S.C. 154(b) by 0 days.

(21) Appl. No.: 17/239,494

(22) Filed: Apr. 23, 2021

(65) Prior Publication Data

US 2021/0330047 A1 Oct. 28, 2021

Related U.S. Application Data

(60) Provisional application No. 63/015,976, filed on Apr. 27, 2020.

(51) Int. Cl.

| | |
|---|---|
| ***A45C 3/12*** | (2006.01) |
| ***A45C 3/06*** | (2006.01) |
| ***A45C 13/02*** | (2006.01) |
| ***A45C 13/12*** | (2006.01) |
| ***A45C 13/10*** | (2006.01) |
| ***A45C 7/00*** | (2006.01) |
| ***A45C 13/36*** | (2006.01) |

(52) U.S. Cl.

CPC ..... *A45C 3/12* (2013.01); *A45C 3/06* (2013.01); *A45C 7/0063* (2013.01); *A45C 13/02* (2013.01); *A45C 13/103* (2013.01); *A45C 13/1092* (2013.01); *A45C 13/123* (2013.01); *A45C 13/36* (2013.01)

(58) Field of Classification Search

CPC ..... A45C 3/12; A45C 3/06; A45C 7/0063; A45C 13/02; A45C 13/103; A45C 13/1092; A45C 13/123; A45C 13/36; A45C 7/0086

USPC ..... 206/292; 109/108, 110

See application file for complete search history.

(56) References Cited

U.S. PATENT DOCUMENTS

| | | | | |
|---|---|---|---|---|
| 1,818,030 A * | 8/1931 | Arnold | A45C 3/12 383/38 |
| 2,276,765 A * | 3/1942 | De Gree | A45C 3/12 383/41 |
| 2,661,824 A * | 12/1953 | Nelson, Jr. | A45C 13/02 190/109 |
| 2,904,091 A * | 9/1959 | Reed | A45C 3/06 150/117 |
| 3,963,102 A * | 6/1976 | Carp | A45C 3/00 190/110 |
| 10,159,317 B2 * | 12/2018 | O'Such | A45C 13/02 |
| 10,278,463 B2 | 5/2019 | Osnowitz | |

(Continued)

FOREIGN PATENT DOCUMENTS

| | | | |
|---|---|---|---|
| GB | 2473852 A * | 3/2011 | A45C 3/12 |

*Primary Examiner* — John K Fristoe, Jr.
*Assistant Examiner* — Justin Caudill
(74) *Attorney, Agent, or Firm* — Lori Woodward

(57) ABSTRACT

A convertible clutch and footwear storage system is disclosed herein. The present invention includes a convertible clutch-style purse for conveniently storing various items. The convertible clutch includes a first compartment for storing personal items such as a wallet, money, ID, cosmetics, etc.; and a second compartment for storing footwear. The convertible clutch is movable from a folded condition to an unfolded condition. In the folded condition, the second compartment is sized to store flat shoes such as flip flops. In the unfolded condition, the second compartment is sized to store high heel shoes.

13 Claims, 12 Drawing Sheets

(56) References Cited

U.S. PATENT DOCUMENTS

| | | | | |
|---|---|---|---|---|
| 2006/0090823 | A1* | 5/2006 | Repke | A45C 13/02 190/110 |
| 2007/0000796 | A1* | 1/2007 | Kameoka | A45C 11/24 206/278 |
| 2007/0017947 | A1* | 1/2007 | Fenton | A45F 3/04 224/652 |
| 2008/0237068 | A1 | 10/2008 | Melamed | |
| 2011/0146856 | A1 | 6/2011 | Vancelette | |
| 2012/0012235 | A1* | 1/2012 | Freiman | A45C 13/02 150/112 |
| 2012/0103481 | A1* | 5/2012 | Nieves | A45C 13/10 150/113 |
| 2013/0039605 | A1 | 2/2013 | Gavrieli | |
| 2013/0048164 | A1* | 2/2013 | Fleming | A45C 13/02 150/113 |
| 2013/0292014 | A1* | 11/2013 | Mosee | A45C 13/02 150/107 |
| 2014/0352859 | A1* | 12/2014 | Brown | A45C 3/06 150/112 |
| 2016/0045001 | A1* | 2/2016 | Marsh | A45C 7/0063 190/107 |
| 2016/0051018 | A1 | 2/2016 | Cornelius | |
| 2016/0095400 | A1* | 4/2016 | Lawton | A45C 13/02 206/278 |
| 2019/0116950 | A1 | 4/2019 | Gray | |

* cited by examiner

HANDBAG WITH SHOE COMPARTMENT

CROSS REFERENCE TO RELATED APPLICATION

The present application is related to and claims priority to U.S. Provisional Patent Application No. 63,015,976 filed Apr. 27, 2020, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of purses and bags and more specifically relates to convertible purses and bags.

2. Description of Related Art

Bags, such as purses, are known for being used to carry a wide variety of items depending on the needs of the user at the time. High-heeled shoes which are primarily designed for their aesthetic characteristics, rather than user comfort, are commonly worn, especially by women, but can be impractical in everyday life. In particular, it may be difficult to perform certain activities with such shoes, and regular prolonged or excessive use may result in foot pain for the wearer. It is therefore advantageous for wearers of such footwear to be able to conveniently change into other shoes when the opportunity arises. Additionally, it may also be desirable to change one's shoes simply to be appropriately dressed for an event or function in accordance with the formality thereof. A suitable solution is desired for storing shoes between uses.

U.S. Pat. No. 10,278,463B2 to Rebecca Sax Osnowitz relates to a convertible bag. The described convertible bag includes a first sidewall, a second opposing sidewall, and a foldable base. The foldable base is coupled to the first sidewall and the second side wall. The foldable base includes a first rigid panel coupled to a second rigid panel such that the foldable base is configured to fold from a generally flat configuration to a folded configuration, thereby converting the bag from an expanded configuration to a collapsed configuration.

BRIEF SUMMARY OF THE INVENTION

In view of the foregoing disadvantages inherent in the known purses and bags art, the present disclosure provides a novel handbag with shoe compartment. The general purpose of the present disclosure, which will be described subsequently in greater detail, is to provide a convertible handbag for conveniently storing various items. The present invention is superior to other systems in that it effectively stores flip flops or other shoes between uses.

A convertible footwear storage clutch-bag is disclosed herein. The convertible footwear storage clutch-bag may include a convertible handbag having a deformable skin defined by an outer surface, an inner lining, and an interior volume including a first-compartment and a second-compartment; and a top flap coupled to the outer surface of the deformable skin. The first-compartment may be configured to retain at least one personal item and the second-compartment may be configured to retain at least one article of footwear. The top flap may be configured to secure the at least one personal item and the at least one article of footwear within the interior volume of the convertible handbag during an 'in-use' condition. Further, the deformable skin of the convertible handbag may augment the interior volume of the convertible handbag when unpacked from a folded condition.

A method of use for a convertible footwear storage clutch-bag is also disclosed herein. The method of use for a convertible footwear storage clutch-bag may comprise the steps of: providing the convertible footwear storage clutch-bag as above; selectively-storing at least one personal item in said first-compartment; and selectively-storing a first article of footwear in said second-compartment.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a convertible footwear storage clutch-bag, constructed and operative according to the teachings of the present disclosure.

The various embodiments of the present invention will hereinafter be described in conjunction with the appended drawings, wherein like designations denote like elements.

DETAILED DESCRIPTION

The present invention is directed to a convertible footwear storage clutch-bag. Generally, in one embodiment of the present invention, the convertible footwear storage clutch-bag may comprise an envelope-style purse with two storage compartments to provide a convertible and functional storage clutch. One of the compartments may include enough room to hold a wallet, ID, money, cell phone, lip gloss and keys. Another one of the storage compartments may be configured to hold flip flops when the envelope-style purse is in an unbuckled/unlatched position. The envelope-style purse may be configured to unbuckle/unlatch and fold out into a bigger configuration that is sized to store high heels. In this bigger configuration, the envelope-style purse may include a generic shoe box size.

The present disclosure further teaches a "to-go" bag. The to-go bag may include a small square that is easily foldable into a compact size, enabling the to-go bag to fit into a case, such as a business card holder. The to-go bag may further include two hooks including double-sided snaps. One side of the hooks may attach to the to-go bag, and an opposite side of the hooks may attach to an external bag (such as a purse already owned by a user of the to-go bag).

Figure 1:
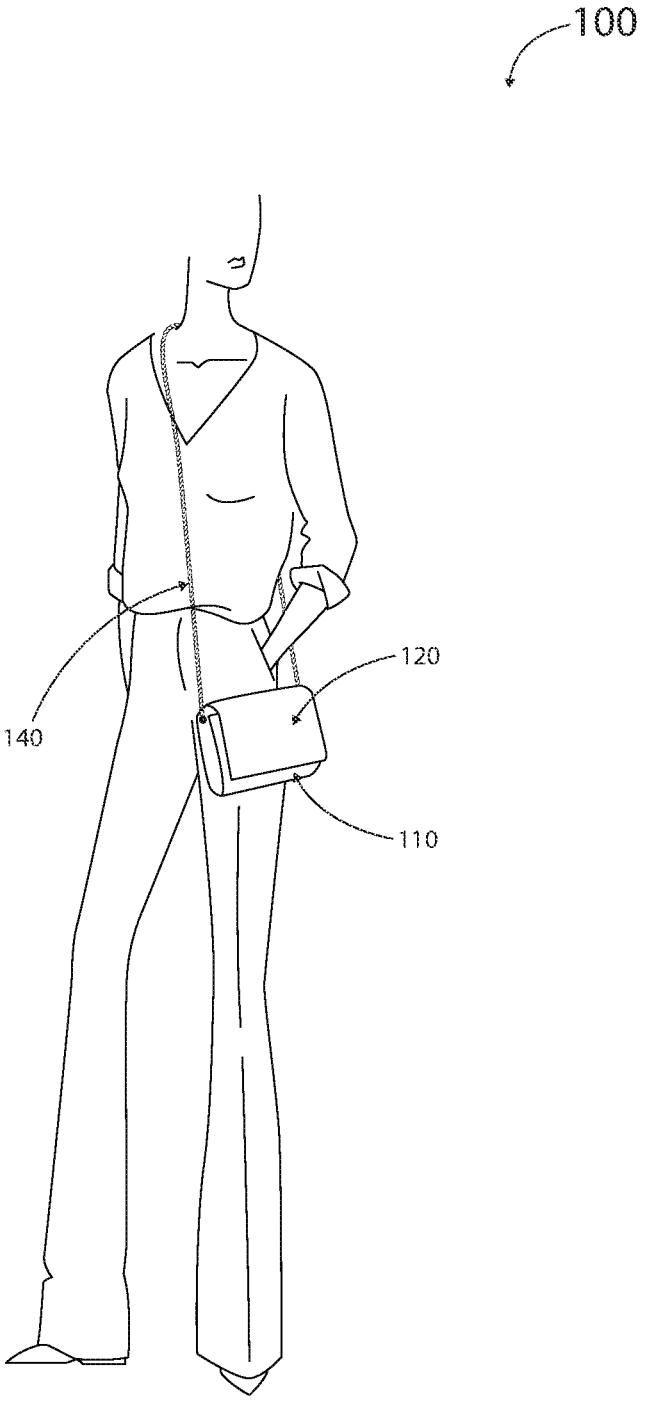
FIG. 1 is a perspective view of a convertible footwear storage clutch-bag during an 'in-use' condition, according to an embodiment of the disclosure.

Referring now more specifically to the drawings by numerals of reference, there is shown in FIGS. 1-8, various views of a convertible footwear storage clutch-bag 100. FIG. 1 shows the convertible footwear storage clutch-bag 100 including at least: a convertible handbag 110 and a top flap 120. Further, in some embodiments, the convertible footwear storage clutch-bag 100 may include a strap 140 for attaching the convertible handbag 110 to a user and for facilitating carrying the convertible handbag 110 on the user. For example, as shown in FIG. 1, the strap 140 may be configured to carry the convertible handbag 110 around a shoulder of a user. In this version, the convertible handbag 110 may be a crossbody bag, a satchel, a shoulder bag, or the like. However, other embodiments are also contemplated. For example, in some embodiments, the strap 140 may be configured to carry the convertible handbag 110 around a wrist of the user. In this embodiment, the convertible handbag 110 may be a clutch, a wristlet, a top handle bag, or the like. It should be appreciated that the aforementioned handbag types are given as examples.

Preferably, the convertible handbag 110 may include a deformable skin defined by an outer surface 112, an inner lining 113, and an interior volume 111. The deformable skin may augment the interior volume 111 of said convertible handbag 110 when unpacked from a folded condition 104. The deformable skin may thus be constructed from a malleable material. For example, the deformable skin may be leather (such as genuine cow leather, vegan leather, or the like), nylon, canvas, etc. The deformable skin may preferably enable the convertible handbag 110 to be expanded from the folded condition 104 to an unfolded condition 106.

Figure 2A:
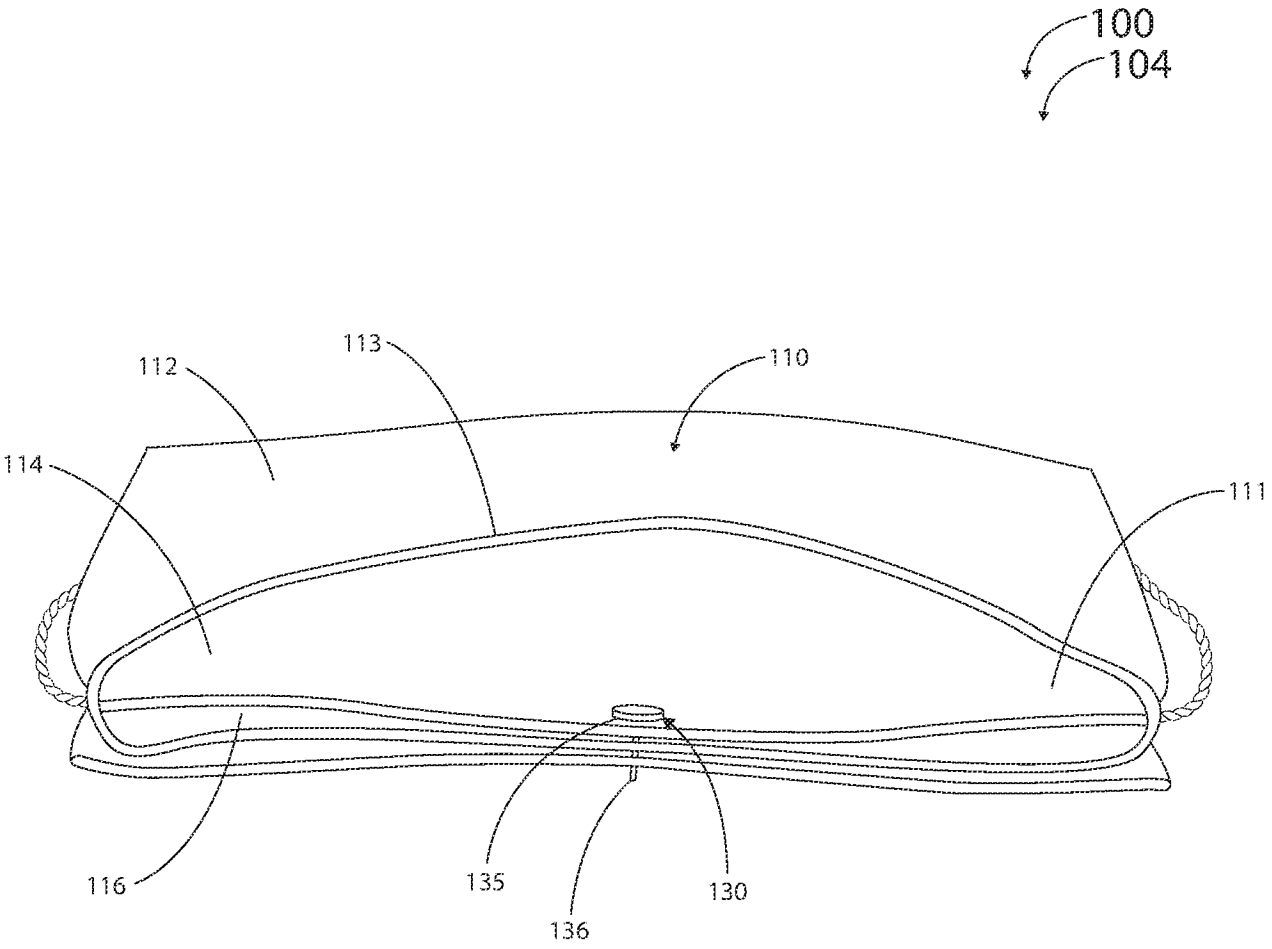
FIG. 2A is a top perspective view of the convertible footwear storage clutch-bag, illustrating a convertible handbag having two compartments and the convertible handbag being in a folded condition, according to an embodiment of the present disclosure.
Figure 2B:
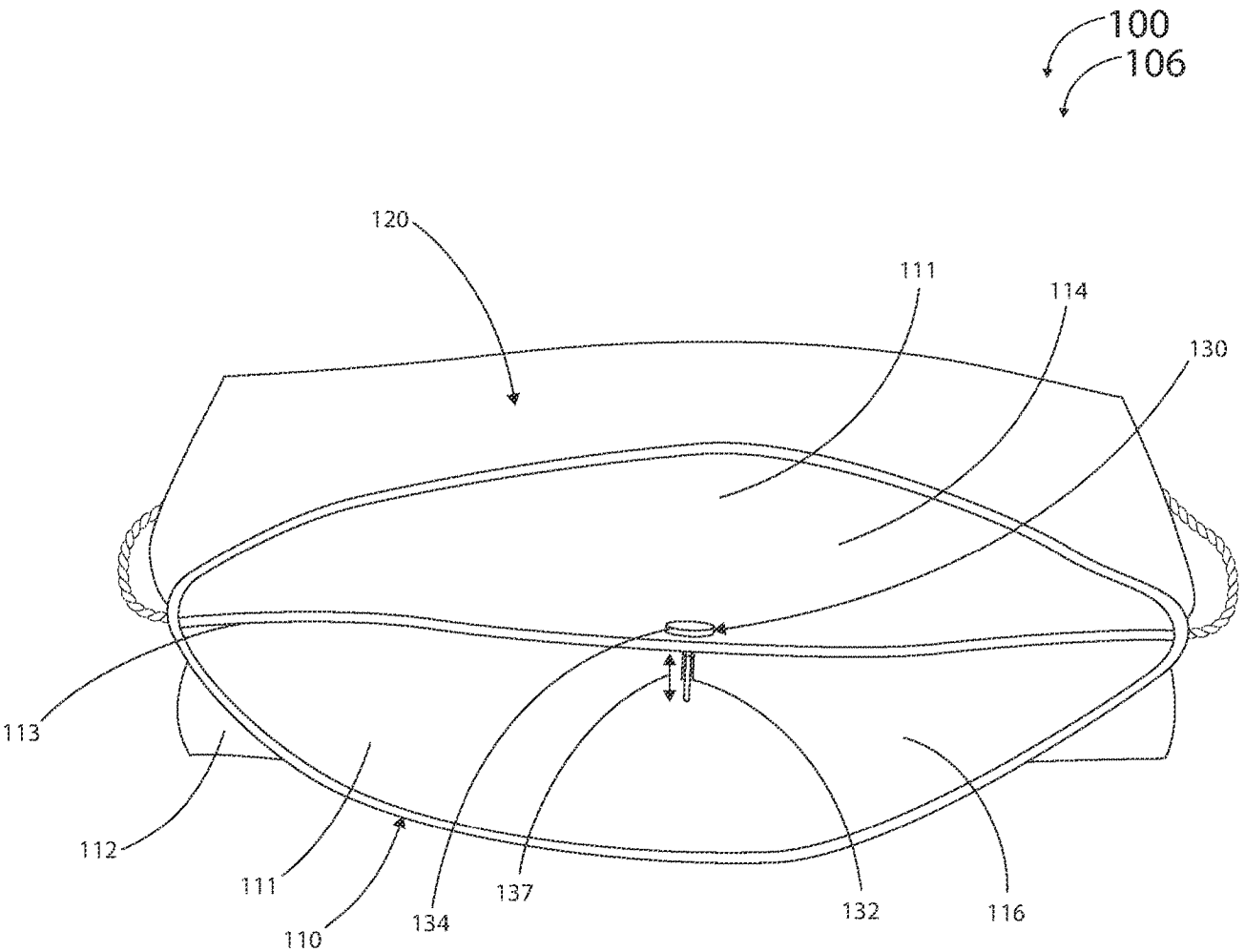
FIG. 2B is a top perspective view of the convertible footwear storage clutch-bag illustrating the convertible handbag having the two compartments and the convertible handbag being in an unfolded condition, according to an embodiment of the present disclosure.

As shown in FIGS. 2A-2B, the interior volume 111 may include a first-compartment 114 and a second-compartment 116. The second-compartment 116 may be located at a front of the convertible handbag and the first-compartment 114 may be located behind the second-compartment 116. This may be relative to a wearer when the convertible handbag 110 is in use, for example, the first-compartment 114 may be closest to the user.

The convertible handbag 110 may include a fastener 130 configured to releasably secure the second-compartment 116. In some embodiments, the fastener 130 may comprise a latch 132. In other embodiments, the fastener 130 may comprise a buckle 134. The second-compartment 116 may be selectively folded (placing the convertible handbag 110 into the folded condition) or selectively unfolded (placing the convertible handbag 110 into the unfolded condition 106). As such, as shown in FIG. 2A, the fastener 130 may also be configured to secure the second-compartment 116 (and thus the convertible handbag 110) in the folded condition 104. In some embodiments, the fastener 130 may be attached to the inner lining 113 of the convertible handbag 110.

For example, as shown in FIGS. 2A-2B, the fastener 130 may include a first fastener-end 135 opposite a second fastener-end 136 and defining a fastener-length 137 therebetween. Further, the convertible handbag 110 may include a first aperture 118 located at a first section of the front thereof and a second aperture 119 located at a second section of the front. The first section of the front may be at a top of the front of the convertible handbag 110. The first fastener-end 135 may be attached to a rear side of the second-compartment 116, and the second fastener-end 136 (and the fastener-length 137) may be threaded through the first aperture 118 to secure the second-compartment 116.

In addition, the second section of the front may be at a bottom of the front of the convertible handbag 110 when the convertible handbag 110 is in the unfolded condition 106. As such, when the bottom is folded (the convertible handbag being in the folded condition 104), the second fastener-end 136 (and the fastener-length 137) may be threaded through the first aperture 118 and the second aperture 119 to secure the second-compartment 116 and also secure the convertible handbag 110 in the folded condition 104. It should be appreciated that other fasteners may also be contemplated and the fastener 130 is not limited to the configurations discussed above. For example, the fastener 130 may be a snap fastener, a magnet, a button, or the like.

Figure 3A:
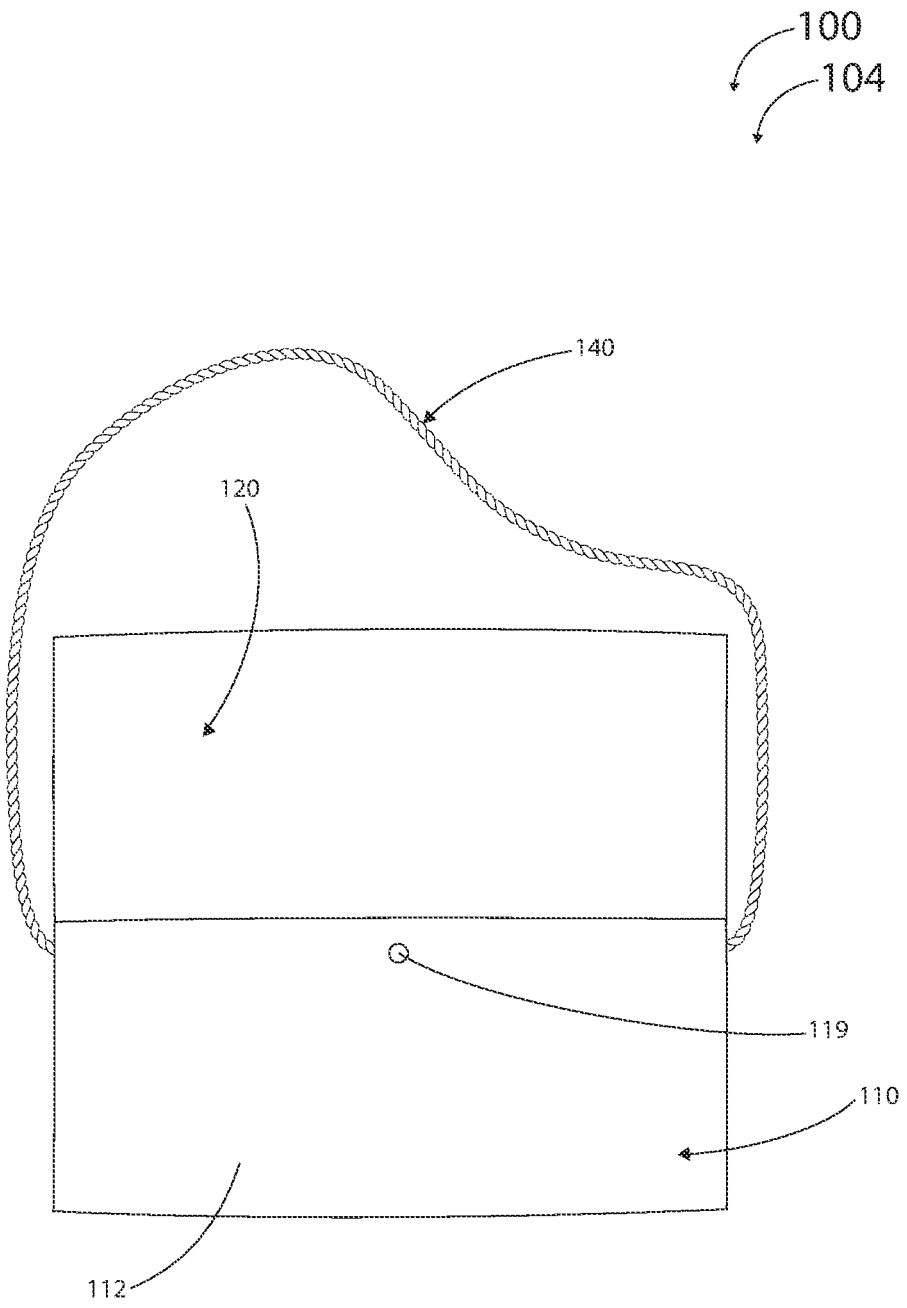
FIG. 3A is a front view of the convertible footwear storage clutch-bag illustrating the convertible handbag in the folded condition, according to an embodiment of the present disclosure.
Figure 3B:
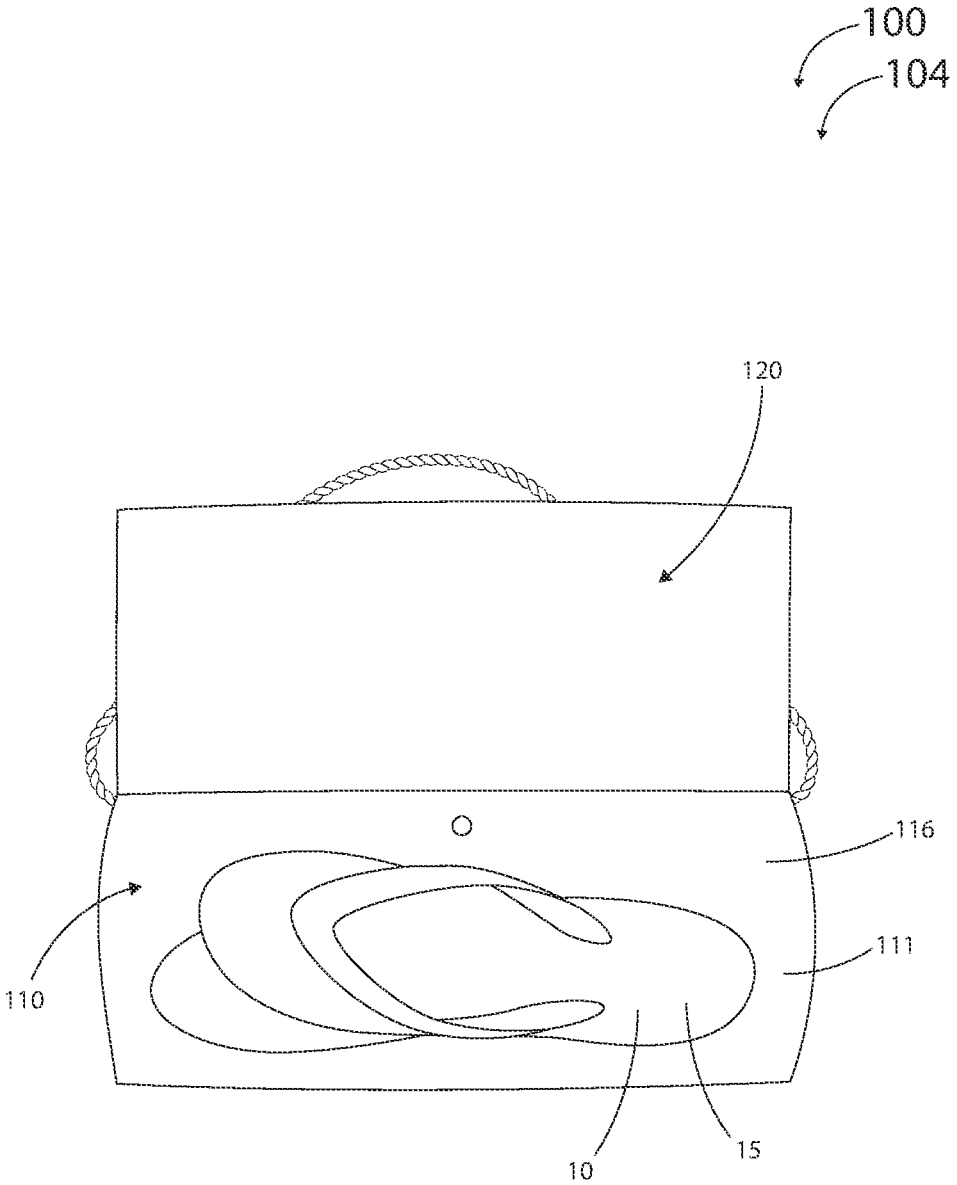
FIG. 3B is a front view of the convertible footwear storage clutch-bag illustrating the convertible handbag in the folded condition and storing a pair of flip flops in a second compartment thereof, according to an embodiment of the present disclosure.
Figure 3C:
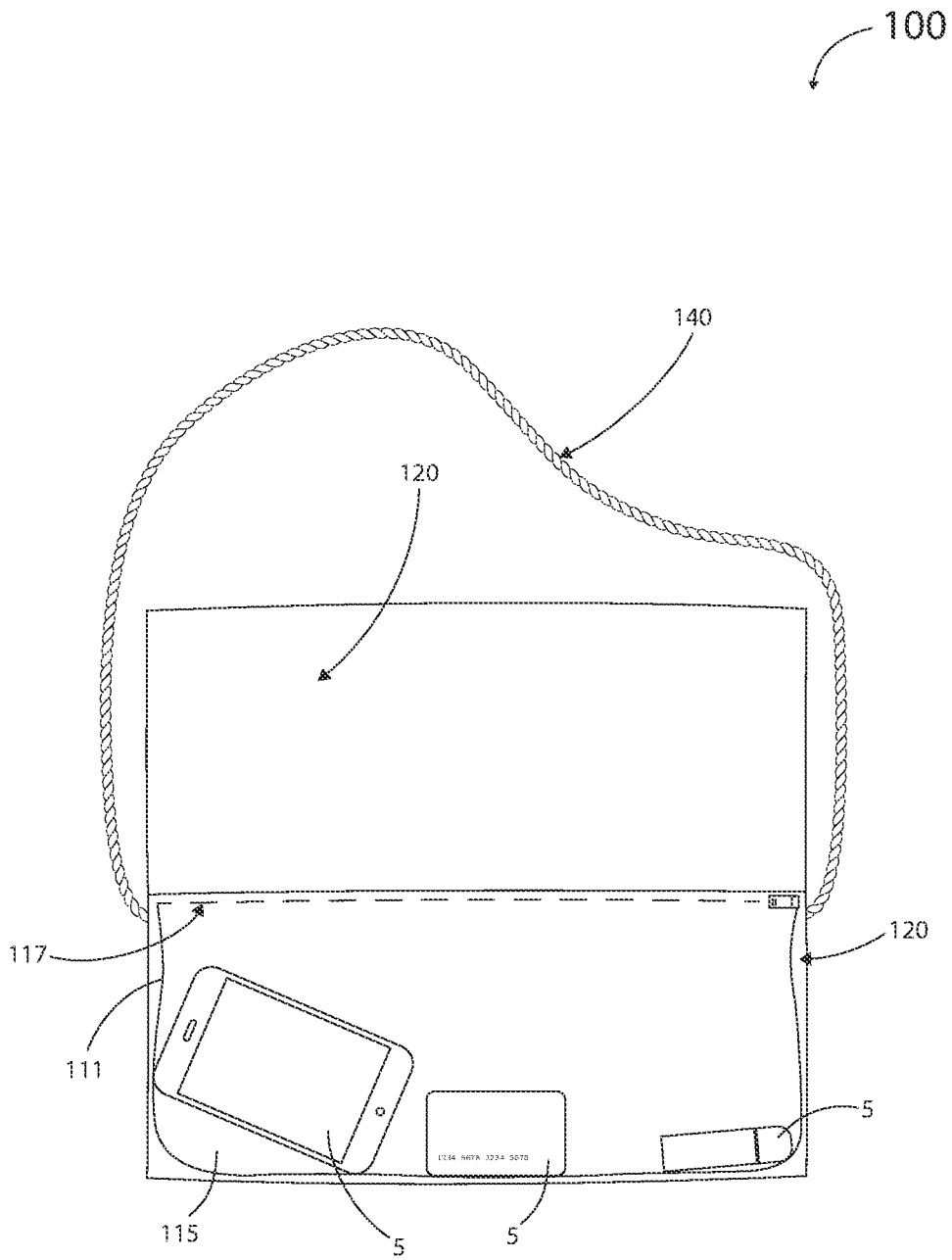
FIG. 3C is a rear view elf the convertible footwear storage clutch-bag illustrating the convertible handbag in the folded condition and storing personal items in a first compartment thereof, according to an embodiment of the present disclosure.

As shown in FIG. 3C, preferably, the first-compartment 114 may be configured to retain at least one personal item 5.

In some embodiments, the first-compartment 114 may further comprise an internal pocket 115 configured to house the at least one personal item 5. Further, the internal pocket 115 may include a closure means for securing the at least one personal item 5 therein. For example, the internal pocket 115 may include a zipper 117. However, other closure means may also be contemplated.

As shown in FIG. 3C, the at least one personal item 5 may be a cell phone, a credit card, cash, an identification card, a cosmetic item, food, medication, etc. The at least one personal item 5 may preferably be a plurality of personal items. As such, the first-compartment 114 and the internal pocket 115 may be sized to accommodate the plurality of personal items. For example, the first-compartment 114 and the internal pocket 115 may be sized to accommodate at least a cell phone, a credit card, cash and an identification card.

The second-compartment 116 may be configured to retain at least one article of footwear 10. Preferably, the second-compartment 116 may be configured to retain the at least one article of footwear 10 in both the folded condition 104 and unfolded condition 106. When in the folded condition 104, the second-compartment 116 may be configured to retain the at least one article of footwear 10 wherein the at least one article of footwear 10 includes a flatter profile 15. For example, as shown in FIG. 3B, the at least one article of footwear 10 including the flatter profile 15 may be a pair of flip flops. Other examples of footwear 10 including the flatter profile 15 may be ballet flats, sandals, tennis shoes, or the like.

When in the unfolded condition 106, the second-compartment 116 may be configured to retain the at least one article of footwear 10 wherein the at least one article of footwear 10 includes a larger profile 20. For example, as shown in FIG. 4B, the at least one article of footwear 10 including the larger profile 20 may be a pair of high heel shoes, a pair of wedges, or the like. This may allow a user of the convertible footwear storage clutch-bag 100 to remove their high heel shoes (for example if the high heel shoes become uncomfortable), remove the flatter profile 15 shoes from the second-compartment 116, insert the high heel shoes into the second-compartment 116 and put the flatter profile 15 shoes on. It should also be appreciated that in the unfolded condition 106, the second-compartment 116 is larger, and therefore is still able to hold the article of footwear 10 including the flatter profile 15. In some examples, in the unfolded condition 106, the second-compartment 116 may include a generic shoe box size. It should be appreciated that the convertible handbag 110 is shown to be transparent in FIGS. 3B, 3C and 4B for illustrative purposes only.

Figure 4A:
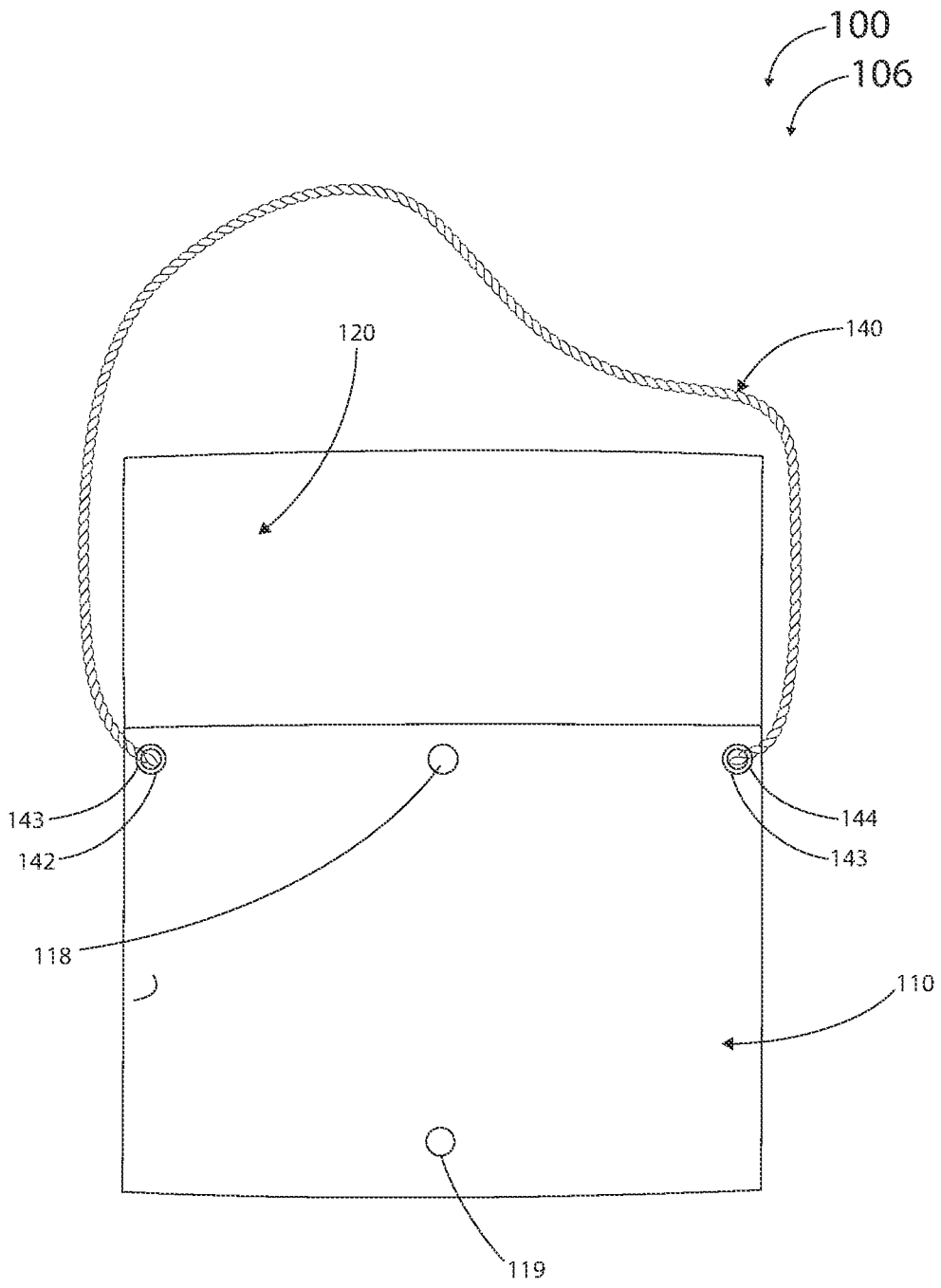
FIG. 4A is a front view of the convertible footwear storage clutch-bag illustrating the convertible handbag in the unfolded condition, according to an embodiment of the present disclosure.
Figure 4B:
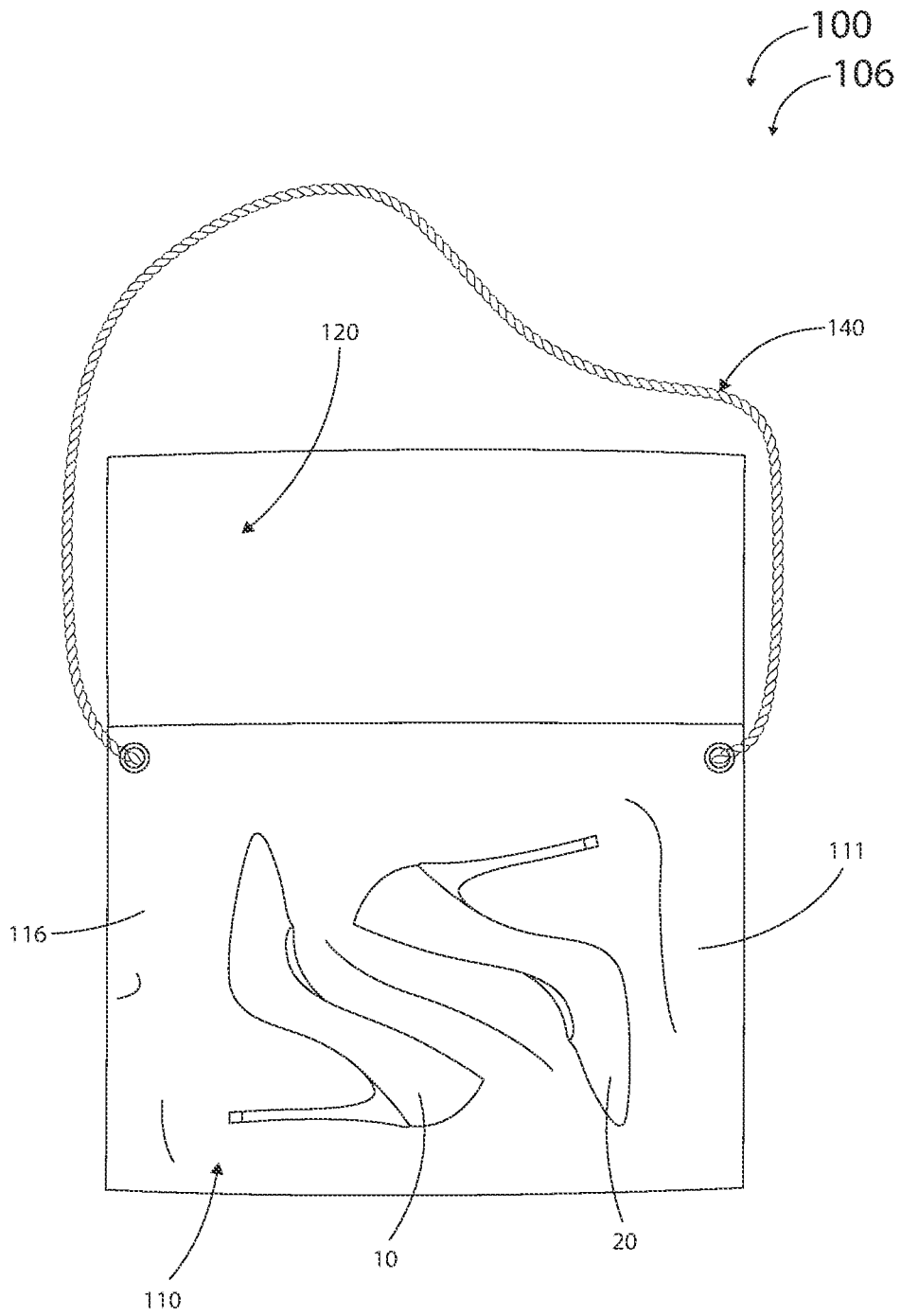
FIG. 4B is a front view of the convertible footwear storage clutch-bag illustrating the convertible handbag in the unfolded condition and storing a pair of high heels in the second compartment thereof, according to an embodiment of the present disclosure.

As shown in FIGS. 4A-4B, the convertible handbag 110 may further comprise a first-eyelet 142 and a second-eyelet 144. The first-eyelet 142 and the second-eyelet 144 may be configured to receive and retain the strap 140 in a fixed position. As such, the first-eyelet 142 and the second-eyelet 144 may be the means in which attaches the strap 140 to the convertible handbag 110. Further, as shown, the first-eyelet 142 and the second-eyelet 144 may each comprises a metallic ring 143 structured and arranged to provide reinforcement to the strap 140. However, it should be appreciated that the strap 140 is not limited to this attachment means, nor is the convertible handbag 110 limited to comprising the strap 140. Further, as shown in FIG. 4A, the top flap 120 may be coupled to the outer surface 112 of the deformable skin. The top flap 120 may be configured to secure the at least one personal item 5 and the at least one article of footwear 10 within the interior volume 111 of the convertible handbag 110 during an 'in-use' condition.

Figure 5:
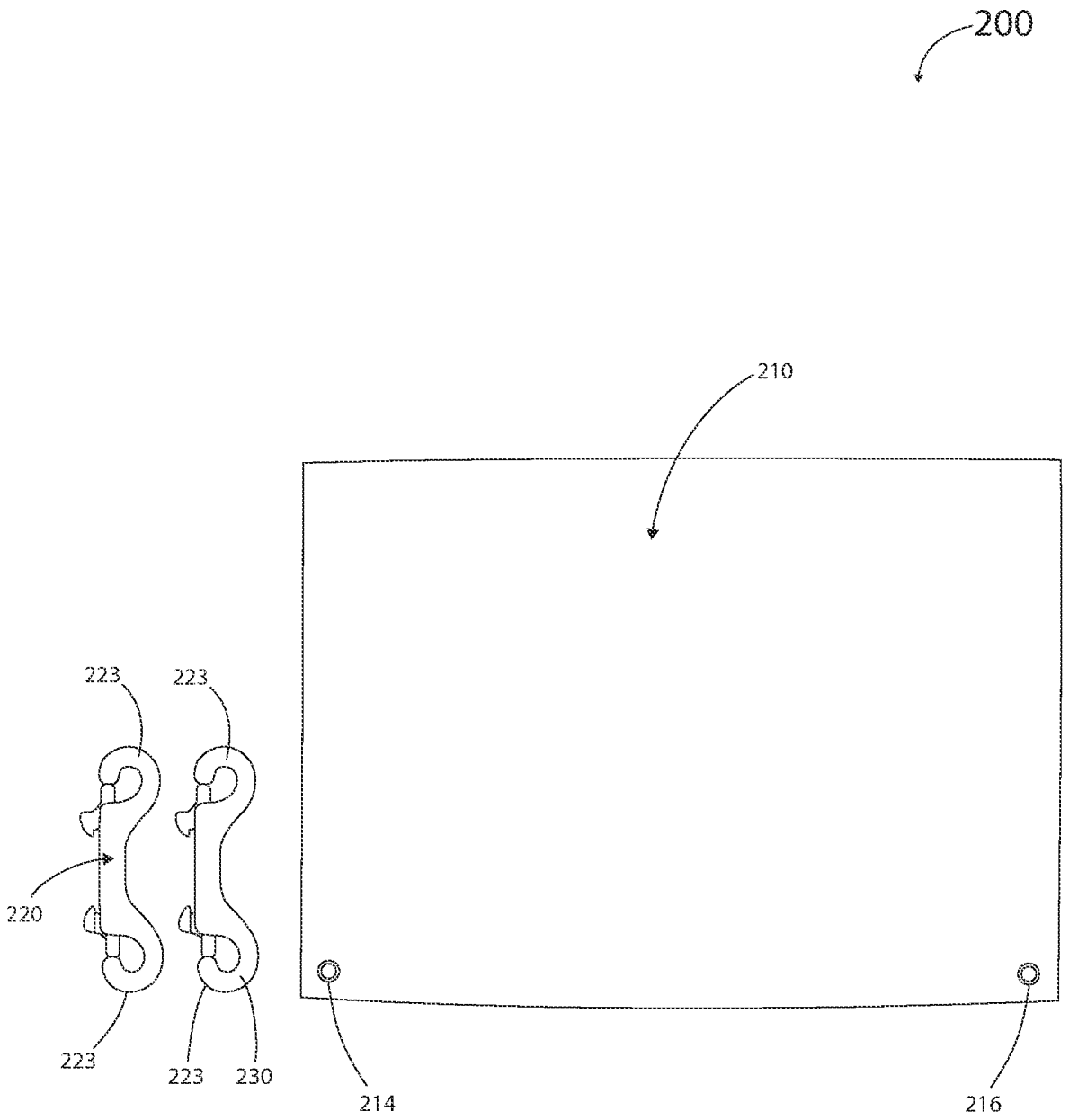
FIG. 5 is a front view of an auxiliary bag system illustrating a pouch, a first clip, and a second clip according to an embodiment of the present disclosure.
Figure 6:
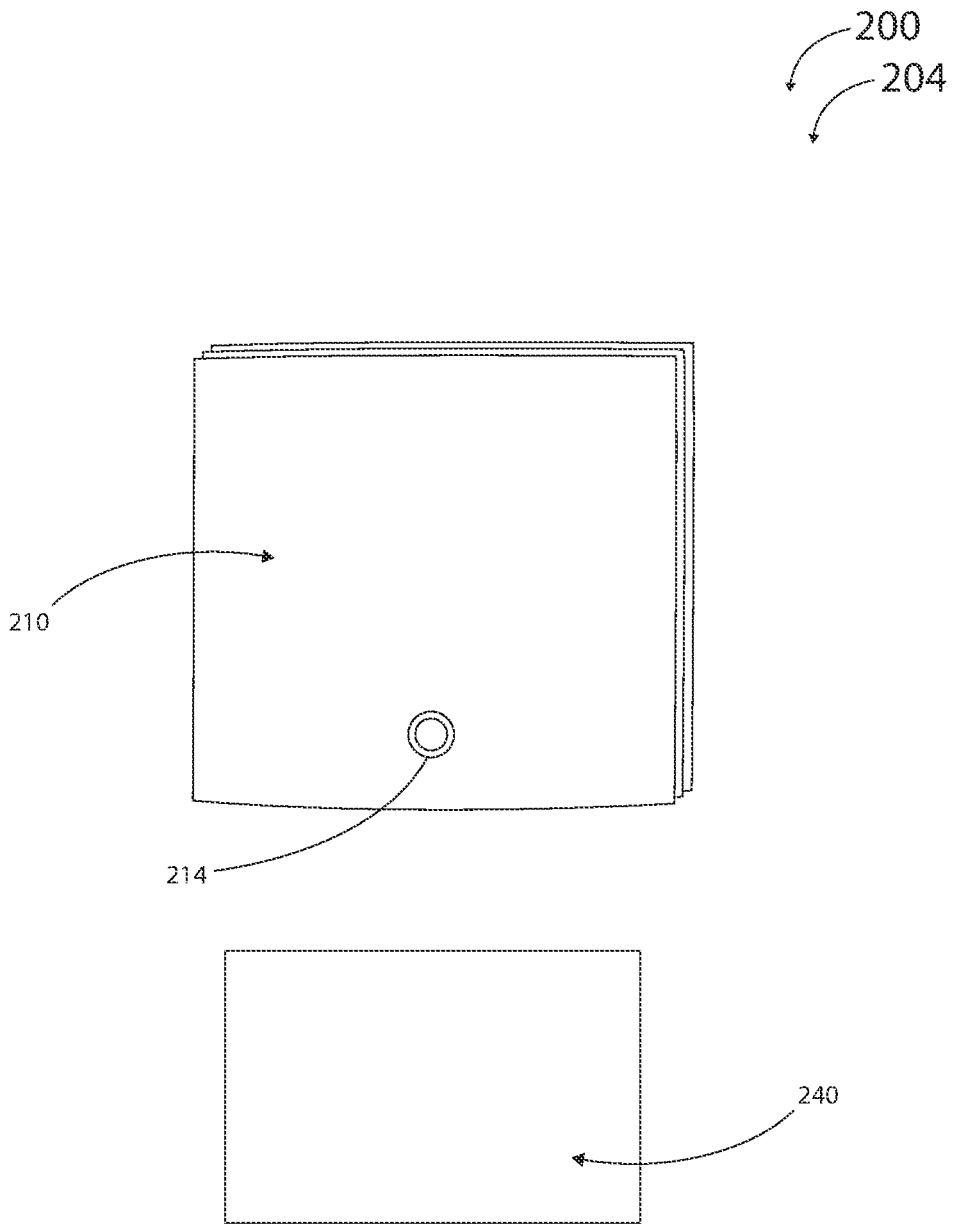
FIG. 6 is a front perspective view of the auxiliary bag system illustrating the pouch folded into a compact configuration and a compact carrying case, according to an embodiment of the present disclosure.
Figure 7:
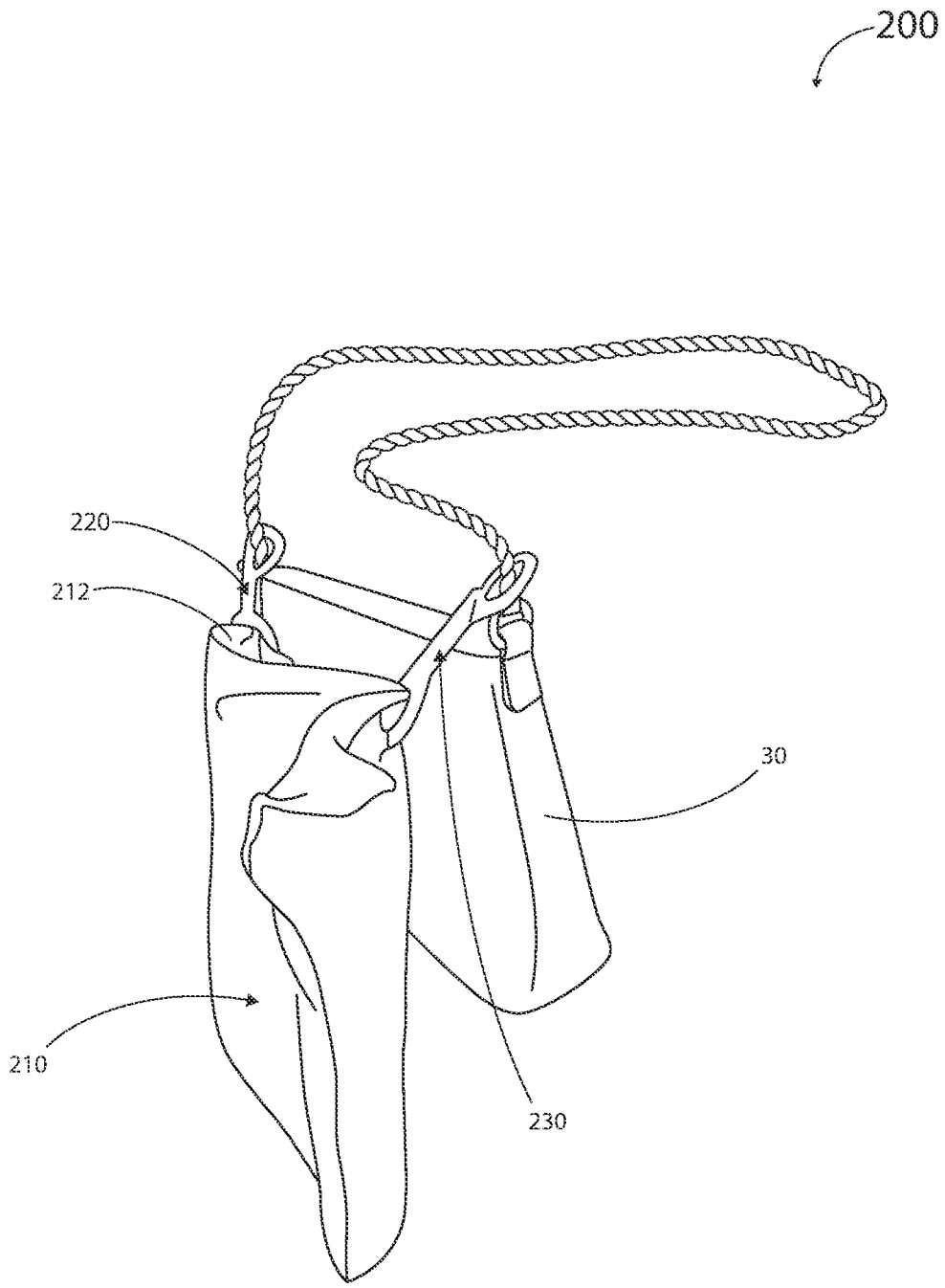
FIG. 7 is a side perspective view of the auxiliary bag system illustrating the pouch being attached to an independent handbag, according to an embodiment of the present disclosure.

Referring now to FIGS. 5-7, there is shown an auxiliary bag system 200. The auxiliary bag system 200 may include a pouch 210 having an opening 212, a first thru-hole 214 and a second thru-hole 216. The opening 212 of the pouch 210 may be configured to receive at least one personal article belonging to the user. For example, the personal article may be footwear 10 such as flip flops or high heels. Preferably, the pouch 210 may be constructed of a lightweight and durable material. The lightweight and durable material may be weather resistant for protecting the at least one personal article 5 from outside elements. In some embodiments, the lightweight and durable material may be a ripstop fabric. For example, the ripstop fabric may be nylon.

Further, the pouch 210 may be configured to fold into a compact configuration 204. To aid in this, the lightweight and durable material may be a thin material such that when folded into the compact configuration 204, the pouch 210 does not comprise a substantial thickness. As such, the pouch 210 may be configured to fit into a compact carrying case 240. In some embodiments, the auxiliary bag system 200 may further comprise the compact carrying case 240 configured to retain the pouch 210 when the pouch 210 is folded. In another embodiment, the compact carrying case 240 may be independent of the auxiliary bag system 200. For example, the compact carrying case 240 may be a business card holder, identification card holder, etc.

The auxiliary bag system 200 may further comprise a first clip 220 and a second clip 230. The first clip 220 may be configured to removably attach the pouch 210 to a primary bag 30 via the first thru-hole 214 located on the pouch 210. Similarly, the second clip 230 may be configured to removably attach the pouch 210 to the primary bag 30 via the second thru-hole 216 located on the pouch 210. In some embodiments, the first clip 220 and the second clip 230 may each comprise a double-side snap 223.

The primary bag 30 may be independent of the auxiliary bag system 200 and the auxiliary bag system 200 may increase an aggregate storage capacity of the primary bag 30. For example, if the user needs to carry their footwear 10 and their primary bag 30 does not have the storage capacity but the user still wishes to utilize the primary bag 30, they may attach the pouch 210 to the primary bag 30 and store their footwear 10 (or any other personal article 5) therein. The user may conveniently carry the pouch 210 (in the folded, compact configuration 204), the first clip 220 and the second clip 230 in the compact carrying case 240. When needed, the user may unfold the pouch 210 for use.

Figure 8:
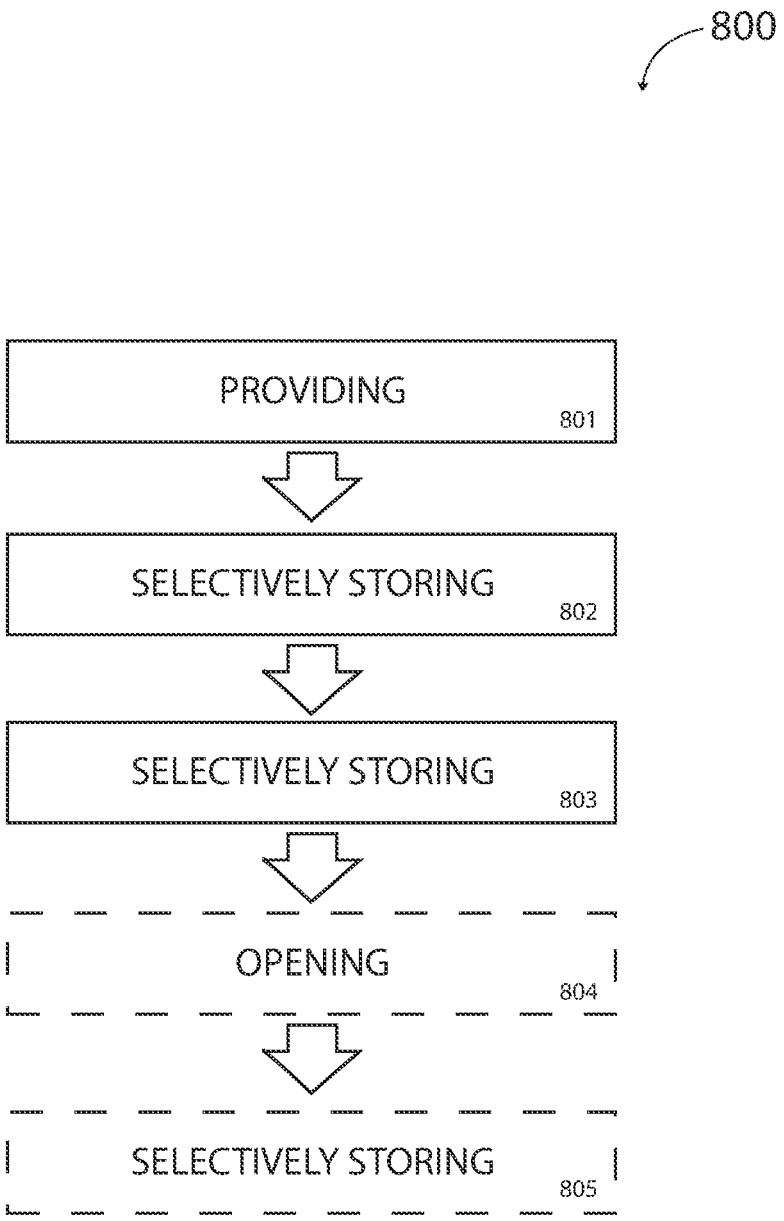
FIG. 8 is a flow diagram illustrating a method of use for a convertible footwear storage clutch, according to an embodiment of the present disclosure.

FIG. 8 is a flow diagram illustrating method of use for a convertible footwear storage clutch-bag 800, according to an embodiment of the present disclosure. As illustrated, the method of use 800 may include the steps of: step one 801, providing the convertible footwear storage clutch-bag as above; step two 802, selectively-storing at least one personal item in said first-compartment; and step three 803, selectively-storing a first article of footwear in said second-compartment. Further steps may include step four 804, opening said fastener to expand said interior volume of said convertible handbag; and step five 805, selectively-storing a second article of footwear in said interior volume of said convertible handbag, wherein said second article of footwear is larger in mass than said first article of footwear.

It should be noted that steps four 804 and five 805 are optional steps and may not be implemented in all cases. Optional steps of the method of use 800 are illustrated using dotted lines in FIG. 8 so as to distinguish them from the other steps of the method 800. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc. other methods for the aiding in slicing of at least one food item on a substantially planar surface (e.g., different step orders within above-mentioned list, elimination or addition of certain steps, including or excluding certain maintenance steps, etc.), are taught herein.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment(s) were chosen and described in order to best explain the principles of the present invention and its practical application, to thereby enable others skilled in the art to best utilize the present invention and various embodiments with various modifications as are suited to the particular use contemplated.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A convertible clutch-bag having a top, a bottom, a front side and a back side, the top and bottom defining a height, the forward side and a rear side defining a length, the convertible clutch-bag comprising:

a deformable skin having an outer surface, the outer surface including a first outward-facing face and a second outward-facing face, the first and the second outward-facing faces facing away from each other substantially perpendicular to the length and height;

a personal item compartment within the deformable skin, the personal item compartment having a first outer side and a first inner side, said first outer side proximate the first outward-facing face, said first inner side distal from the first outward-facing face; and a shoe compartment within the deformable skin and adjacent to the personal item compartment, the shoe compartment reconfigurable between a compact state and an extended state, said extended state having a greater volume than the compact state, the shoe compartment having a second outer side and a second inner side, said second outer side proximate the second outward-facing face, said second inner side distal from the second outward-facing face; and wherein the shoe compartment is configured to fold upon itself such that a bottom portion of the shoe compartment in its extended state can be brought proximate its open top thus folding the shoe compartment into its compact state.

2. The convertible clutch-bag of claim 1, wherein the personal item compartment and the shoe compartment each having an open top.

3. The convertible clutch-bag of claim 2, further comprising a top flap coupled to the deformable skin, and configured to close the open tops of the personal item compartment and of the shoe compartment.

4. The convertible clutch-bag of claim 1, wherein the bottom portion of the shoe compartment is coupled proximate its open top when in its compact state.

5. The convertible clutch-bag of claim 4, further comprising a latch configured to wherein couple the bottom portion of the shoe compartment proximate the open top of the shoe compartment when the shoe compartment is arranged in its compact state.

6. The convertible clutch-bag of claim 1, further comprising a strap configured to carry the convertible clutch-bag over a shoulder of a user.

7. The convertible clutch-bag of claim 6, wherein the strap is further configured to be worn on a wrist of the user.

8. A convertible clutch-bag having a top, a bottom, a forward side and a rear side, the top and bottom defining a height, the front side and the back side defining a length, the convertible clutch-bag comprising:

a deformable skin having an outer surface, the outer surface including a first outward-facing face and a second outward-facing face, the first and the second outward-facing faces facing away from each other substantially perpendicular to the length and height;

a personal item compartment within the deformable skin, the personal item compartment having a first outer side and a first inner side, said first outer side proximate the first outward-facing face, said first inner side distal from the first outward-facing face; and a shoe compartment within the deformable skin and adjacent to the personal item compartment, the shoe compartment reconfigurable between a compact state and an extended state, said extended state having a greater volume than the compact state, the shoe compartment having a second outer side and a second inner side, said second outer side proximate the second outward-facing face, said second inner side distal from the second outward-facing face; and wherein the shoe compartment has a first length, and a compact height when in its compact state and an extended height when in its extended state; and wherein the personal item compartment has a second length and a second height, said second length and second height being substantially similar to the first length and the compact height of the shoe compartment, respectively.

9. The convertible clutch-bag of claim 8, wherein the compact height of the shoe compartment when in its compact state is approximately half the extended height of the shoe compartment when in its extended state.

10. The convertible clutch-bag of claim 8, wherein the first length and the compact height of the shoe compartment are sized and dimensioned to fit an adult flip flop shoe heel-to-toe and side-to-side, respectively.

11. The convertible clutch-bag of claim 10, wherein the shoe compartment has an expandable width defined as perpendicular to its length and height, said expandable width being at least as wide as the side-to-side distance of the adult flip flop shoe.

12. The convertible clutch-bag of claim 8, further comprising a strap configured to carry the convertible clutch-bag over a shoulder of a user.

13. The convertible clutch-bag of claim 12, wherein the strap is further configured to be worn on a wrist of the user.

* * * * *